United States Patent [19]

Sarkis

[11] 4,171,704

[45] Oct. 23, 1979

[54] FLYING PIPE

[76] Inventor: Joseph E. Sarkis, 437 79th St., Brooklyn, N.Y. 11209

[21] Appl. No.: 851,819

[22] Filed: Nov. 16, 1977

[51] Int. Cl.[2] ..... A24F 3/00; A24F 5/10

[52] U.S. Cl. ..... 131/178; 131/176; 131/226; 46/74 D

[58] Field of Search ..... 131/178, 170.12, 186, 131/175, 225, 226, 260, 176; 273/106 B; 46/74 D

[56] References Cited

U.S. PATENT DOCUMENTS

| | | | |
|---|---|---|---|
| 2,010,708 | 8/1935 | Adams | 131/176 |
| 3,543,768 | 12/1970 | Law | 131/175 |
| 4,071,035 | 1/1978 | Boyd et al. | 131/173 |

FOREIGN PATENT DOCUMENTS

| | | | |
|---|---|---|---|
| 568470 | 6/1945 | United Kingdom | 131/174 |

*Primary Examiner*—Stephen C. Pellegrino
*Attorney, Agent, or Firm*—Hubbell, Cohen, Stiefel & Gross

[57] ABSTRACT

A flying pipe comprising a disc of the type adapted for manual toss and glide; a housing defining a chamber for receiving a smokeable substance; means for securing the housing to the disc; access means to the chamber for accommodating placement of the smokeable substance therein; a pair of spaced apertures in the housing in communication with the chamber; and means associated with the housing for blocking the passage of the smokeable substance through the apertures.

3 Claims, 2 Drawing Figures

FLYING PIPE

BACKGROUND OF THE INVENTION

1. Field of the Invention

This invention pertains to pipes and more particularly to pipes of the hand-held variety.

2. Prior Art

Pipes of all kinds, are, of course, well known. Prior art pipes are, however, generally suited for only one purpose, namely smoking a smokeable substance such as cigarette or pipe tobacco. In addition, manual toss and glide devices are also known. See, for example, U.S. Pat. No. 3,359,678 assigned to the Wham-O Manufacturing Company.

SUMMARY OF THE INVENTION

According to the present invention, I have developed a flying pipe which serves both as a pipe and an amusement device.

In accordance with the preferred embodiment, the flying pipe includes a disc of the type adapted for manual toss and glide and a housing defining a chamber for receiving a smokeable substance. The housing is desirably a hollow generally cylindrical member comprised of a central portion having a pair of end portions removably secured thereto. The disc may, for example, be a Frisbee® brand flying saucer such as the type made by the Wham-O Manufacturing Company.

The housing may be secured to the disc in a number of ways. Preferably, the central portion of the housing includes a portion of reduced diameter adjacent one end thereof which extends through a hole provided in the middle of the disc. The portion extending through the hole may then be secured to one end portion thereby securing the pipe to the disc. This may be accomplished, for example, by threadably engaging an internally threaded wall of the end portion with an externally threaded wall of the portion extending through the hole.

The other end portion of the housing is also preferably removably secured to the central portion to provide easy access to the housing chamber for facilitating placement of a smokeable substance therein. Typically, the smokeable substance will be tobacco, although, one may wish to use another smokeable substance. A pair of apertures, preferably one in each end portion of the housing, are also provided as are means, such as screens, for blocking passage of the smokeable substance through the apertures.

To use the pipe, a flame is placed adjacent one of the apertures for igniting the smokeable substance in the chamber and the smoke is drawn through the aperture in the other end portion which serves as a mouthpiece. To prevent the mouthpiece from getting too hot, it should be comprised of a material which displays low thermal conductivity.

When the flying pipe is being smoked, the disc serves as a handle. Moreover, since the pipe apertures are disposed on opposite sides of the disc, the disc serves to shield the flame from the user's neck and face. After smoking the pipe, the first user may then toss the disc to a second user and so on. It is important to note that the tossing operation, in addition to being a form of amusement, also serves to cool the housing and hence the smoke.

When the smokeable substance has been used up, one of the end portions may be removed, the residue emptied and a fresh supply of the same or a different smokeable substance inserted in the chamber. The end portion may then be resecured whereupon the pipe is once again ready for use.

These and further features of the flying pipe of the present invention will become more fully apparent from the following detailed description of the preferred embodiment thereof.

DESCRIPTION OF THE PREFERRED EMBODIMENTS

Figure 1:
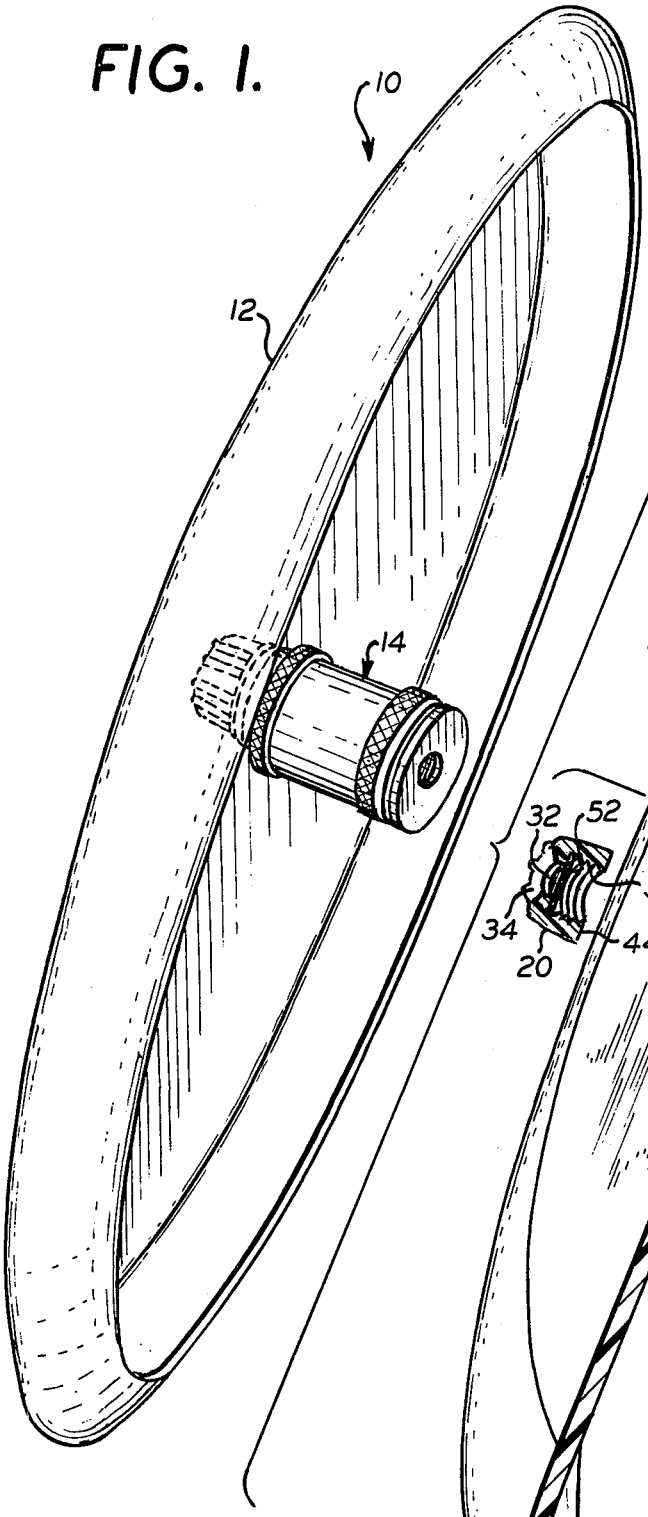
FIG. 1 is a perspective view, partly in phantom, of the flying pipe of the present invention.
Figure 2:
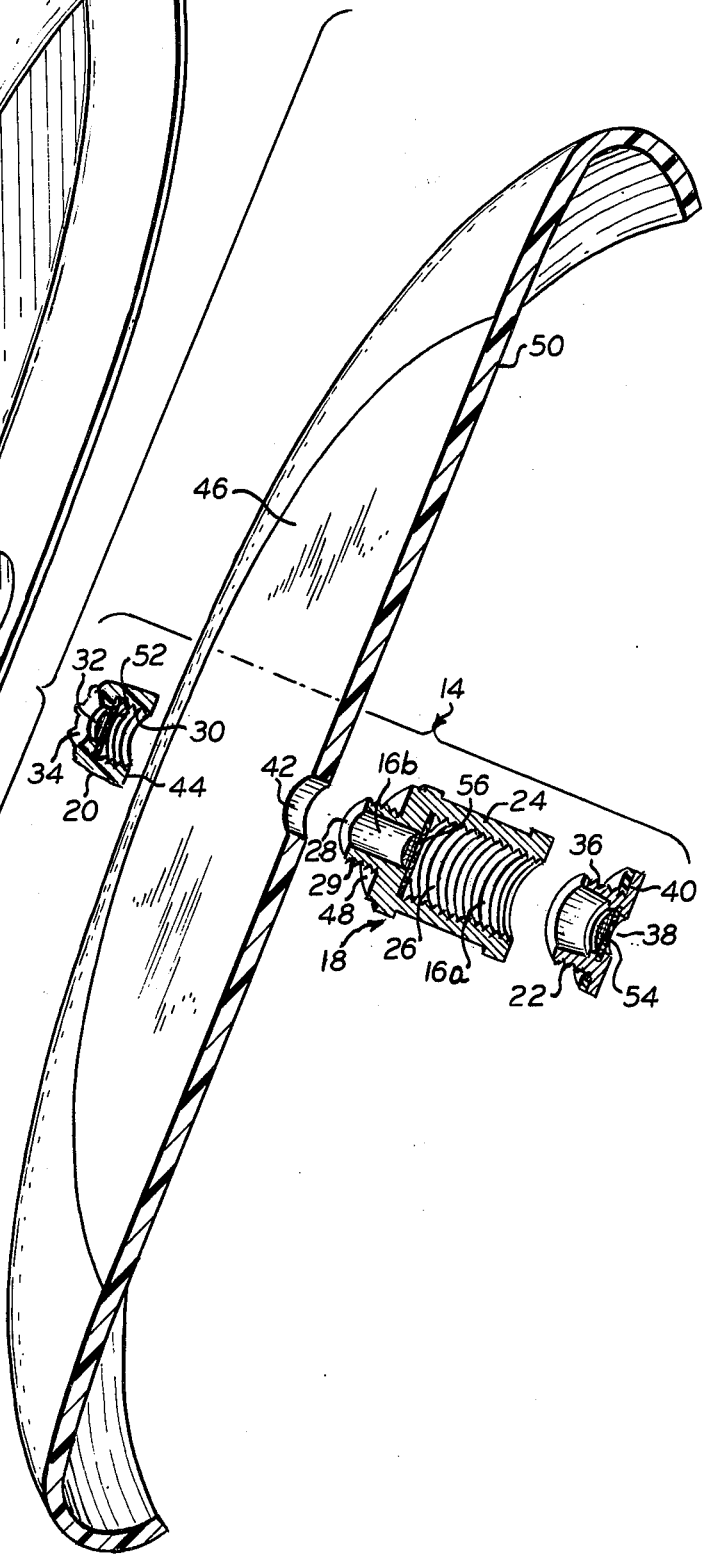
FIG. 2 is an exploded perspective sectional view of the flying pipe illustrated in FIG. 1.

Referring now to the drawing, the flying pipe of the present invention is generally designated by the reference numeral 10 and includes a disc 12 of the type adapted for manual toss glide and a housing 14 defining a chamber 16 for receiving a smokeable substance (not shown).

The disc 12 may be any one of those generically referred to as "flying discs" or "flying saucers" such as, for example, the Super Pro Frisbee® manufactured by the Wham-O Manufacturing Company, San Gabriel, California. As presently preferred and shown, the housing 14 is comprised of a hollow generally cylindrical member having a central portion 18 and end portions 20 and 22.

As illustrated, central portion 18 includes a main portion 24 having an internally threaded wall 26 and a portion of reduced diameter 28 having an externally threaded wall 29. End portion 20 includes an internally threaded cylindrical wall 30 and has an aperture 32 in the transverse wall 34 thereof. The other end portion 22 of the cylindrical member 14 has an externally threaded cylindrical wall 36 and, like the end portion 20, has an aperture 38 in the transverse wall 40 thereof.

As presently preferred and shown, disc 12 has a hole 42 in the center thereof. The diameter of the hole 42 is greater than that of the portion 28 of central cylinder portion 18 but less than that of main portion 24 and end portion 20. Thus, and as shown, end portion 20 and central portion 18 of the cylindrical housing 14 may be secured to each other and to disc 12 by inserting portion 28 through hole 42 and threadably engaging internally threaded wall 30 with externally threaded wall 28. As best shown in FIG. 1, when this is done, transverse annular wall 44 of end portion 20 will be firmly seated adjacent planar surface 46 of the disc 12 and annular transverse wall 48 of the member 18 will be firmly seated adjacent planar surface 50 of the disc 12.

End portion 22 of cylindrical housing 14 is also preferably removably secured to central portion 18. As illustrated, this is accomplished by threadably engaging externally threaded wall 36 of end portion 22 with internally threaded wall 26 of central portion 18.

The pipe 10 also includes means for preventing passage of the smokeable substance through the apertures 32, 38. Desirably, the blocking means comprises screens 52 and 54 seated in the end portions 20 and 22, respectively, in overlying relation with the holes 32 and 38. As presently preferred and shown, an additional screen 56 is disposed in the central portion 18 of the housing 14 between chamber portions 16*a* and 16*b* whereby to prevent passage of the smokeable substance therebetween. While the screens 52, 54 and 56 are preferably fixedly secured to the housing 14, this is not necessary and the screens could, alternatively, be press fitted in place.

In use, the smokeable substance is disposed in the chamber portion 16*a*. The end portion 22 of housing 14 is then secured to the central portion 18 in the manner more fully described above. The substance may then be smoked by placing a match, lighter or other flame source adjacent aperture 38 for igniting the smokeable substance with the resulting smoke being drawn out of chamber 16 through aperture 32 in end portion 20 which, in the embodiment shown, serves as the mouthpiece of the flying pipe 10. Thus, unlike portions 18 and 22 of cylindrical housing 14, which are preferably comprised of any one of a number of suitable metals or their alloys well known to persons skilled in the art, end portion 20 is preferably comprised of plastic such as, for example, polypropelyne or polyethelyne. As is well known, plastic is a relatively poor conductor of heat and thus will prevent the mouthpiece from becoming too hot. Of course, other materials which display poor thermal conductivity may also be used.

While the pipe 10 is being smoked, the body of the disc 12 provides a convenient handle, and since it too is preferably comprised of plastic or some other non-metallic substance, the disc 12 will also remain cool.

When the first user of the pipe 10 is done smoking, he can then pass the pipe to a second user by simply tossing the disc 12 to him in the conventional manner. The second user can then repeat the smoking operation described above and then pass the pipe 10 back to the first user or to a third person. Moreover, the passing of the pipe 10 between the users by manual toss and glide not only provides amusement, but also serves the important function of cooling the cylindrical housing 14 of the pipe 10 and hence the smoke. Also, on windy days, disc 12 may be positioned to block the wind to facilitate lighting of the pipe. Furthermore, by selecting a cylindrical housing and disposing it at the center of the disc 12 as illustrated in the preferred embodiment, the adverse effect, if any, to the aerodynamics of the disc 12 may be minimized.

When the smokeable substance is used up, end portion 22 is removed from central portion 18 and the chamber 16*a* emptied. A fresh supply of the same or a different smokeable substance may then be disposed in the chamber 16*a* and end portion 22 resecured to central portion 18 whereupon the pipe 10 is again ready for use. Clearly, the screens 52 and 54 are necessary to prevent the smokeable substance from falling out of the chamber 16*a* while still allowing the flame to penetrate into the chamber 16*a* through aperture 38 and the smoke to be drawn out through aperture 32. The screen 56 is included to further reduce the possibility that any of the smokeable substance or residue will be drawn into the user's mouth along with the smoke. It is also possible to replace the screen 52 and 56 with a honeycomb screen extending throughout chamber 16*b*. The honeycomb screen, by reducing the turbulence of the smoke being drawn into the use's mouth, serves to further reduce the harshness of the smoke.

While the preferred flying pipe of the present invention has been shown and described, it will be apparent to those skilled in the art that numerous modifications and changes may be made without departing from the spirit and scope of this invention. Thus, housing 14 need not be cylindrical and may be secured to the disc 12 in a variety of ways well known to persons skilled in the art other than that described above. Similarly, means other than a removable end portion 22 may be provided for gaining access to the chamber 16*a*. For example, a small latch door may be provided in the wall defining the chamber 16*a*. Also, means other than screens may be used for preventing the smokeable substance from passing out of the chamber 16*a* through the apertures 32 and 38. Thus, for example, apertures 32 and 38 may be replaced by a plurality of much smaller apertures which could then serve the dual function now served by the combination of apertures 32, 38 and screens 52, 54. Also, while the pipe apertures 32, 38 are preferably disposed on opposite sides of disc 12, this too is not necessary and other pipe aperture locations will also serve.

In addition, to provide added strength and durability to the flying pipe 10 of the present invention, it may be desirable to incorporate ribbing in the flying disc 12 adjacent the aperture 42. If desired, an L-shaped clip, having one leg pivoted to the central portion 18 of the housing 14 and movable to a position in which the other leg overlies end portion 22, may be added to prevent accidental disattachment of end portion 22 from central portion 18 during flight. Means other than clips as well as other types of clips may also be used for this purpose. Finally, it is also possible to incorporate a whistle in the flying pipe 10, preferably in the mouth piece 20. The whistle will sound during flight thus aiding the recipient of a toss to locate the Frisbee when ambient lighting is poor.

Since these and other modifications are within the scope of the present invention, the above description should be construed as illustrative and not in the limiting sense.

What is claimed is:

1. A flying pipe comprising:

a disc having a circumferential wall means whereby said disc is adapted for manual tossing and gliding;

a housing defining a chamber for receiving a smokeable substance, said housing having a pair of spaced apertures therein in communication with the chamber;

means for securing the housing substantially at the center of the disc with one of said apertures on one side of said disc and the other of said apertures on the other side of said disc;

access means to the chamber for accommodating placement of the smokeable substance therein; and means secured to the housing for blocking passage of the smokeable substance through said apertures whereby the smokeable substance may be smoked by disposing a flame adjacent one of the apertures and drawing the resulting smoke through the other of the apertures.

2. The flying pipe of claim 1, wherein:

the disc has a hole in the center thereof;

the housing comprises a hollow generally cylindrical member defining said chamber, said cylindrical member including a central portion and a pair of end portions;

said means for securing the pipe to the housing comprises means for securing one end portion of the cylindrical member to the central portion thereof through said hole;

said access means comprises means for removably securing the other end portion of said cylindrical member to the central portion thereof whereby when said portions are separated said chamber is exposed;

one of said apertures is in one of said end portions and the other of said apertures is in the other of said end portions; and said blocking means comprises screens secured to said cylindrical member in overlying relation with said apertures.

3. The flying pipe of claim 2, wherein:

said means for securing said one end portion of said cylindrical member to the central portion thereof comprises:

the portion of said cylindrical member nearest said one end portion being externally threaded and having a diameter less than said hole; and said one end portion being internally threaded for threadably engaging said externally threaded portion; and said means for removably securing the other end portion of said cylindrical member to said central portion comprises:

the portion of said central member adjacent said other end portion being internally threaded; and said other end portion being externally threaded for threadably engaging said internally threaded cylinder portion; and further comprising an additional screen disposed in the portion of said chamber defined by said central cylinder portion between said portion of reduced diameter and the remaining portion thereof.

* * * * *